US007412979B2

(12) United States Patent
Green

(10) Patent No.: US 7,412,979 B2
(45) Date of Patent: Aug. 19, 2008

(54) SELECTIVE REMOVAL OR APPLICATION OF A COATING ON A PORTION OF A CONTAINER

(75) Inventor: Bobby R. Green, Brighton, CO (US)

(73) Assignee: Ball Corporation, Broomfield, CO (US)

( * ) Notice: Subject to any disclaimer, the term of this patent is extended or adjusted under 35 U.S.C. 154(b) by 615 days.

(21) Appl. No.: 10/892,504

(22) Filed: Jul. 14, 2004

(65) Prior Publication Data

US 2005/0205112 A1 Sep. 22, 2005

Related U.S. Application Data

(60) Provisional application No. 60/554,111, filed on Mar. 17, 2004.

(51) Int. Cl.
*B08B 9/00* (2006.01)

(52) U.S. Cl. ..... 134/22.1; 134/22.12; 134/22.18; 134/26; 134/30; 134/32; 134/34; 134/35; 134/36; 134/40; 134/42

(58) Field of Classification Search ..... 134/22.1, 134/22.12, 22.18, 26, 30, 32, 34, 36, 35, 134/40, 42

See application file for complete search history.

(56) References Cited

U.S. PATENT DOCUMENTS

| | | | | |
|---|---|---|---|---|
| 3,620,813 | A | 11/1971 | Minbiole, Jr. et al. | 117/94 |
| 3,664,354 | A | 5/1972 | Minbiole, Jr. et al. | 136/61 |
| 3,704,685 | A | 12/1972 | Neumann et al. | 118/6 |
| 3,731,647 | A | 5/1973 | Minbiole, Jr. et al. | 118/5 |
| 3,748,177 | A | 7/1973 | Neumann et al. | 134/30 |
| 3,952,698 | A | 4/1976 | Beyer et al. | 118/314 |
| 4,020,198 | A | 4/1977 | Cornelius et al. | 427/336 |
| 4,102,350 | A * | 7/1978 | Chelton et al. | 134/130 |
| 4,201,664 | A * | 5/1980 | Hekal | 508/111 |
| 4,319,930 | A | 3/1982 | Yano et al. | 134/10 |
| 4,477,290 | A * | 10/1984 | Carroll et al. | 148/274 |
| 5,248,343 | A | 9/1993 | Hamilton et al. | 134/10 |
| 5,332,452 | A | 7/1994 | Das | 148/247 |
| 5,335,682 | A | 8/1994 | Yoshimura et al. | 134/72 |
| 5,356,481 | A | 10/1994 | Yoshimura et al. | 134/22.1 |
| 5,421,899 | A | 6/1995 | Hamilton et al. | 134/10 |
| 5,435,899 | A | 7/1995 | Gimenez et al. | 204/297 |
| 5,445,680 | A | 8/1995 | Hamilton | 134/26 |
| 5,478,597 | A * | 12/1995 | Jorgens | 427/236 |
| 5,564,448 | A | 10/1996 | Lincoln | 134/166 |
| 5,688,755 | A * | 11/1997 | Ikeda et al. | 510/254 |
| 5,746,837 | A | 5/1998 | Beck et al. | 134/2 |
| 5,935,348 | A | 8/1999 | Rossmaier | 148/243 |
| 6,027,579 | A | 2/2000 | Das et al. | 148/256 |
| 6,190,738 | B1 | 2/2001 | Beck | 427/416 |
| 6,193,815 | B1 | 2/2001 | Wada et al. | 148/247 |
| 6,269,823 | B1 | 8/2001 | Lincoln | 134/131 |
| 6,358,566 | B1 | 3/2002 | Rosenfeld | 427/405 |
| 6,369,149 | B1 | 4/2002 | Yoshida et al. | 524/417 |
| 6,495,003 | B1 * | 12/2002 | Rosenfeld | 204/193 |
| 6,585,829 | B1 * | 7/2003 | Suzuki et al. | 134/19 |
| 2005/0205112 | A1 * | 9/2005 | Green | 134/22.1 |

* cited by examiner

*Primary Examiner*—Sharidan Carrillo
(74) *Attorney, Agent, or Firm*—Sheridan Ross P.C.

(57) ABSTRACT

The present invention relates to an apparatus and method for removing a coating material from a predetermined first portion of a container, while retaining the coating on a second portion of the container, or alternatively applying a coating to a predetermined portion of a container or other apparatus.

15 Claims, 10 Drawing Sheets

SELECTIVE REMOVAL OR APPLICATION OF A COATING ON A PORTION OF A CONTAINER

This application claims the benefit of U.S. Provisional Patent Application Ser. No. 60/554,111, Filed Mar. 17, 2004, which is incorporated by reference in its entirety herein.

FIELD OF THE INVENTION

The present invention relates to beverage and food container manufacturing, and more specifically an apparatus and method for selectively removing surface coatings from a defined portion of a container, on end closure, while retaining the coating in other predetermined areas.

BACKGROUND OF THE INVENTION

During the manufacturing of metal containers used in the beverage and food industry, certain coatings are often applied to internal and external surfaces of the containers. These organic and inorganic chemical coatings are applied to prevent cans from staining during retorting and other processes, as well as to prevent corrosion and "scalping", which is the alteration of the taste of a beverage or food stored in a container resulting from the beverage or food contacting the interior surface of the container.

One particular use of coatings involves the use of a "conversion coating", which is typically a zirconium-phosphate coating that is applied to the exterior of a container to prevent staining of the container exterior during retort operations. As described herein, "retort" refers to any operation wherein a beverage or food container is heated beyond 200° F., and more typically between about 250-300° F., and which typically includes exposing the container to steam or hot water having a pH equal to or greater than 7.0, i.e. basic.

Although the conversion coating provides significant advantages when applied to an exterior lower portion, or dome of the container, it has the adverse effect of causing ink and decorative coating adhesion loss on the "neck" or upper portion of containers during manufacturing and retort operations. Hence, the container becomes unfit for its intended purpose and is subsequently discarded, which is both time consuming, expensive, and disruptive to a manufacturing operation. As appreciated by one skilled in the art, in modern can manufacturing facilities with the capability of producing over 20 million containers a day any loss in production is disruptive and expensive.

Thus, there is a significant need in the container industry for a method and apparatus for removing a conversion coating or other similar coating from a predetermined portion of a container, while retaining the coating on another portion of the container. Furthermore, as appreciated by one skilled in the art, the invention is not limited to the selective removal of coatings from containers, but rather may be used in any type of operation when a selective portion of a coating is desired to be applied or removed from a surface or portion of an apparatus. The following disclosure describes an improved apparatus and method for efficiently removing a predetermined amount of conversion coating deposited on a container during production.

SUMMARY OF THE INVENTION

It is thus one aspect of the present invention to provide an apparatus and method for selectively removing a coating from one portion or surface of a container, while retaining the coating on another portion or surface of the container. Thus, in one embodiment of the present invention, an "etchant" tank is provided with a plurality of fluid dispensing nozzles submerged below a solution/air interface of the etching solution. The nozzles generally discharge the solution through a washer mat or screen that supports the containers (typically inverted), and is controlled wherein the etchant tank solution only rises to a predetermined level on the container. Thus, the coating on a lower dome portion of the inverted container is preserved, while the coating on the neck or upper portion of the inverted container is removed, thereby addressing the adverse effect of decreased adhesion performance on the neck of the containers when the containers are later inked and/or retorted. More specifically, retorting operations are performed after a container has been conversion coated and after a portion of the conversion coating of the neck has been removed. The retort process exposes the container to temperatures above 200° F. from steam or hot water that has a pH equal to or greater that 7.0, which can cause ink and decorative coating adhesion loss.

To facilitate the mass treatment of thousands and even millions of containers per day, the washer mat is driven as a conveyor at a predetermined speed, and thus the speed and volume of treated containers may be selectively controlled. As further appreciated by one skilled in the art, the container may be inverted to remove coatings from a selected portion thereof, while retaining the coating on another predetermined portion. Thus, the apparatus and the method provided herein may be used on any object or apparatus that requires the selective removal of a coating material from only a predetermined portion.

It is a further aspect of the present invention to provide a conversion coating removal process that utilizes readily available equipment in a cost effective manner, is simplistic to operate, and is substantially maintenance free. Thus, in one aspect of the present invention, an apparatus is provided which is comprised substantially of an etchant tank, a pump mechanism with associated manifold, a plurality of nozzles, and a moving washer mat that supports a plurality of containers.

It is a further aspect of the present invention to provide an etchant and/or holding tank that maintains a substantially consistent fluid level wherein the height of solution being ejected from the nozzles above the tank solution surface is maintained. Accordingly, in one embodiment of the present invention a level control apparatus is provided in the etchant tank that automatically provides additional water or other solutions to the etchant tank on a continuous basis up to a overflow level of the etchant tank. Alternatively, in another embodiment of the present invention a smaller etchant tank is positioned within a larger holding tank, wherein the etchant tank includes the plurality of upwardly oriented spray nozzles that are in operable communication with a pumping apparatus. When the etchant tank overflows, the excess fluid is captured by the holding tank that includes a conduit that returns the overflow fluid to the pump for recirculation. In this embodiment, the fluid level in the etchant tank is maintained at a constant level. Since the nozzles are positioned in the etchant tank under the fluid level, the distance between the nozzles and the fluid level will necessarily be maintained. In addition, the etchant concentration, temperature, and other parameters may be maintained in the holding tank to ensure a proper solution is introduced to the containers.

In another aspect of the present invention, a method is provided for selectively removing a coating from a portion of a plurality of a container, and comprises the steps of:

providing an etchant tank that contains a solution known to remove a coating from the plurality of containers;

providing a plurality of nozzles in said etchant tank, said nozzles having a discharge port positioned below a surface of said solution;

providing a pump which circulates said solution at a predetermined pressure to said nozzles;

passing the plurality of containers over said nozzles at a predetermined speed and distance; and discharging said solution through said discharge ports toward the plurality of containers, wherein only a portion of the plurality of containers is contacted by said solution to selectively remove the coating from a first portion of the plurality of containers while retaining the coating on a second portion of the plurality of containers.

The Summary of the Invention is neither intended nor should it be construed as being representative of the full extent and scope of the present invention. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these embodiments.

Figure 1:
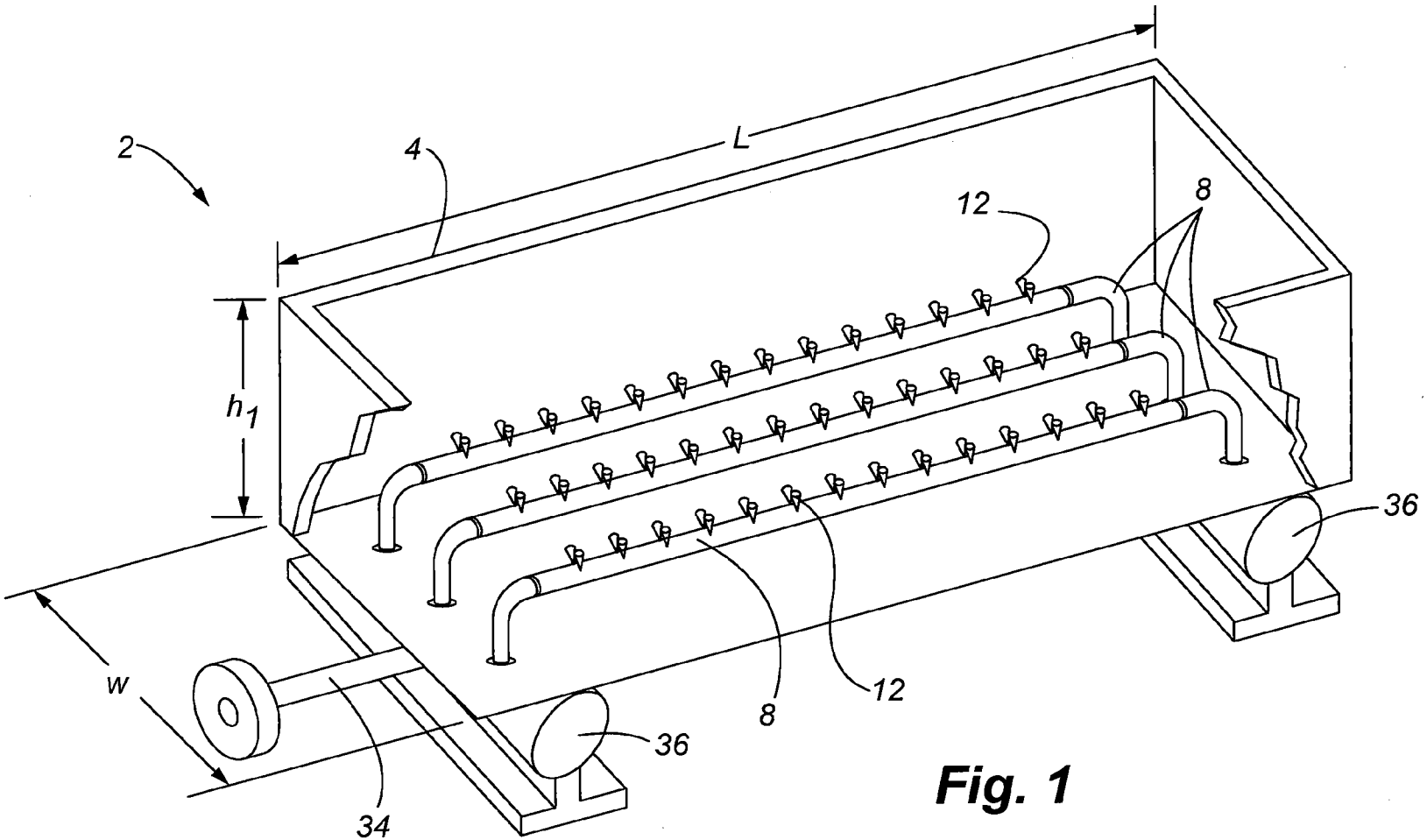
FIG. 1 is a perspective view of one embodiment of the present invention.
Figure 2:
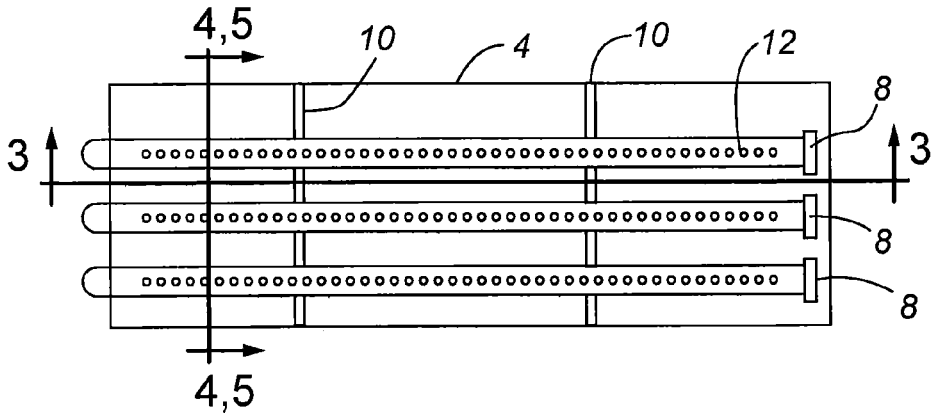
FIG. 2 is a top plan view of the embodiment of the present invention shown in FIG. 1 depicting an etchant tank, a plurality of risers, and a plurality of educator nozzles.

For clarity, the following list of components associated with the present invention, and the numbering related thereto is provided herein:

| # | Component |
|---|---|
| 2 | Coating removal apparatus |
| 4 | Etchant tank |
| 5 | Holding tank |
| 6 | Etching solution |
| 8 | Riser |
| 10 | Riser support |
| 12 | Nozzle |
| 14 | Level control pipe |
| 16 | Liquid/air interface |
| 18 | Moving grid |
| 20 | Pump |
| 22 | Nozzle discharge port |
| 24 | Container |
| 26 | Container neck |
| 28 | Container dome portion |
| 29 | Sidewall |
| 30 | Riser couplings |
| 32 | Nozzle threads |
| 34 | Pump manifold |
| 36 | Header |
| 38 | Drain valve |

It should be understood that the drawings are not necessarily to scale. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION

Referring now to FIGS. 1-10 one embodiment of the present invention is shown herein. In general, the invention utilizes an etchant tank 4 with a plurality of nozzles 12 oriented to direct a flow of an etching solution 6 toward a predetermined portion of a plurality of containers 24, and thus remove only a portion of a coating that has been applied thereto. As appreciated by one skilled in the art, numerous variations of the embodiments provided herein may be utilized to achieve the same results without changing the spirit or novelty of the invention. Further, the apparatus and method described herein is not limited to the treatment of containers. Rather, the apparatus and method may be utilized in any process or application where a portion of an apparatus requires selective coating or selective coating removal while the remaining portion of the apparatus is not altered.

Referring now to FIGS. 1-6, one embodiment of the present invention is shown herein. More specifically, the apparatus generally comprises an etchant tank 4 that is designed to retain the etching tank solution 6 within the confines of the enclosure. As appreciated by one skilled in the art, the etchant tank 4 may also be in the form of a catch basin located in a relatively large area. Within the etchant tank 4, at least one but preferably a plurality of risers 8, are provided that are interconnected to headers 36 that are interconnected to at least one solution supply line. A level control pipe 14 is also provided in one embodiment of the present invention to provide additional etching solution 6 to the etchant tank 4 when the etchant solution level is lowered below a predetermined position.

The coating removal apparatus 2 of the present invention additionally includes a moving washer mat 18 positioned above the etchant tank 4 and the etchant tank liquid/air interface 16 that is adapted to support a plurality of containers 24 that travel at a predetermined speed over the etchant tank 4. In one embodiment, the washer mat 18 is comprised of a wire mesh material, a plastic grid, or other similar materials that allow the treatment solution to readily pass through the washer mat 18 and contact the plurality of containers. As additionally shown in FIG. 1, a plurality of nozzles 12 are interconnected to the risers 8 that provide an upwardly flow of etching solution 6 at a predetermined volume and velocity to create a controlled flow at a level above the washer mat 18, thus operably contacting a predetermined and select portion of the plurality of containers 24. Preferably the etching solution 6 is comprised of an aqueous based liquid having concentrations of nitric and hydrofluoric acids that are designed for efficient removal of the coating on the container, and which have a pH of between about 1.0 and 6.0. Alternatively, any type of liquid may be used to either selectively apply a coating to an apparatus or remove a coating from a selective portion of the apparatus.

The etchant tank 4 is an enclosure capable of retaining the etching solution 6, and in one embodiment is rectangular in shape. As appreciated by one skilled in the art, the etchant tank 4 may have any conceivable shape such circular, oval, square, or other geometries. The etchant tank 4 is generally comprised of a metallic material, although plastics such as polyethylene may be used, as well as concrete, stainless steel, fiberglass, or any other type of substantially chemical and temperature impermeable material that is well known in the art. As further shown in FIG. 3, a pump manifold 34 is provided at a lower most portion of the etchant tank 4 that is interconnected to the risers 8 that provide the necessary etching solution for flow through the nozzles 12. In one preferred embodiment of the present invention, a pump such as a Durco® Mark III with approximately 10-13 horsepower is used that is capable of providing a continuous flow rate of at least about 414 gpm. Preferably, this pump is run at a speed of about 1770-3550 Hz. As appreciated by one skilled in the art, depending on the size of the etchant tank and number of nozzles utilized, the size and output of the pump utilized may be changed.

Figure 3:
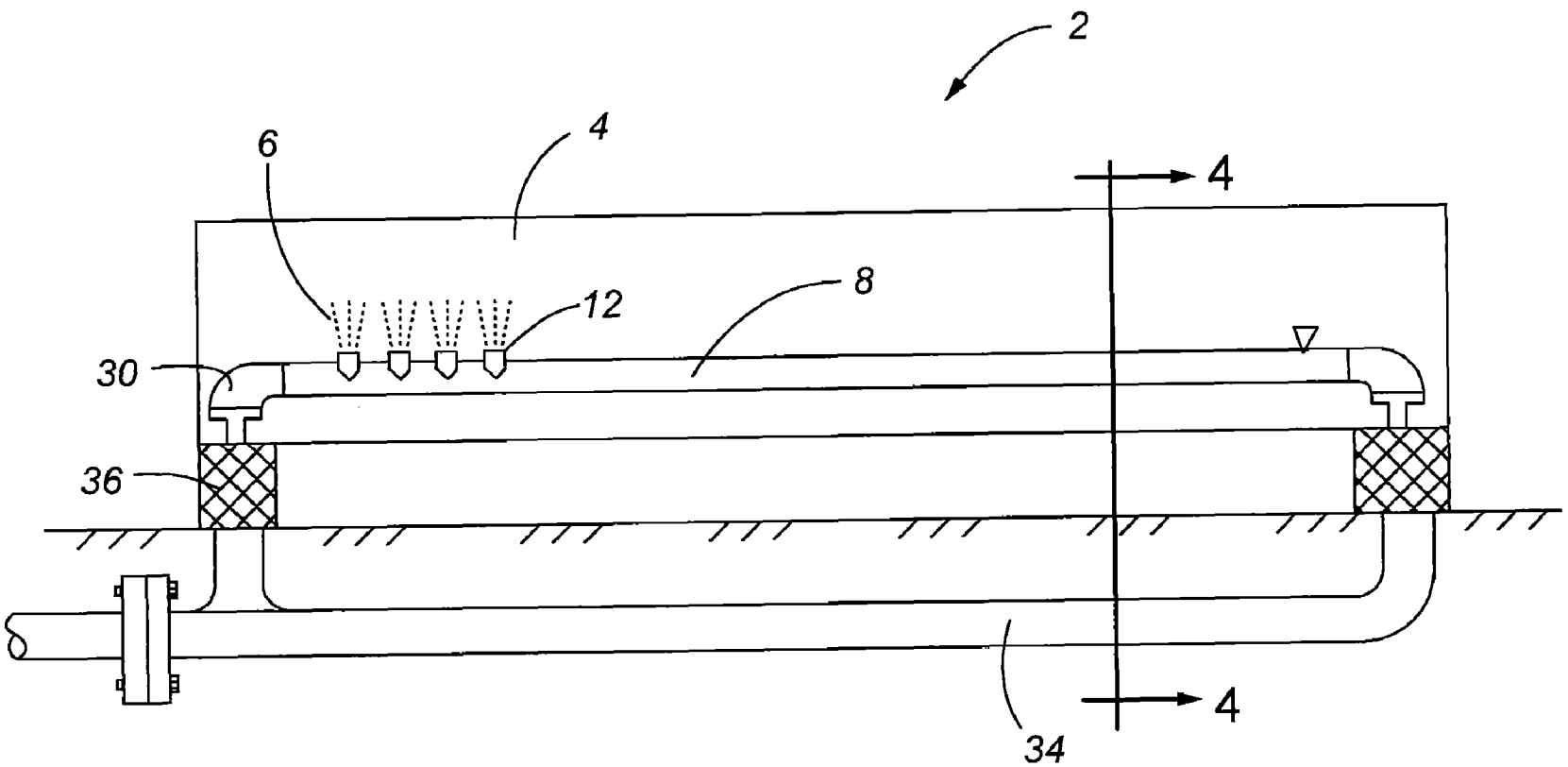
FIG. 3 is a front section view of the embodiment of the invention shown in FIG. 1.
Figure 4:
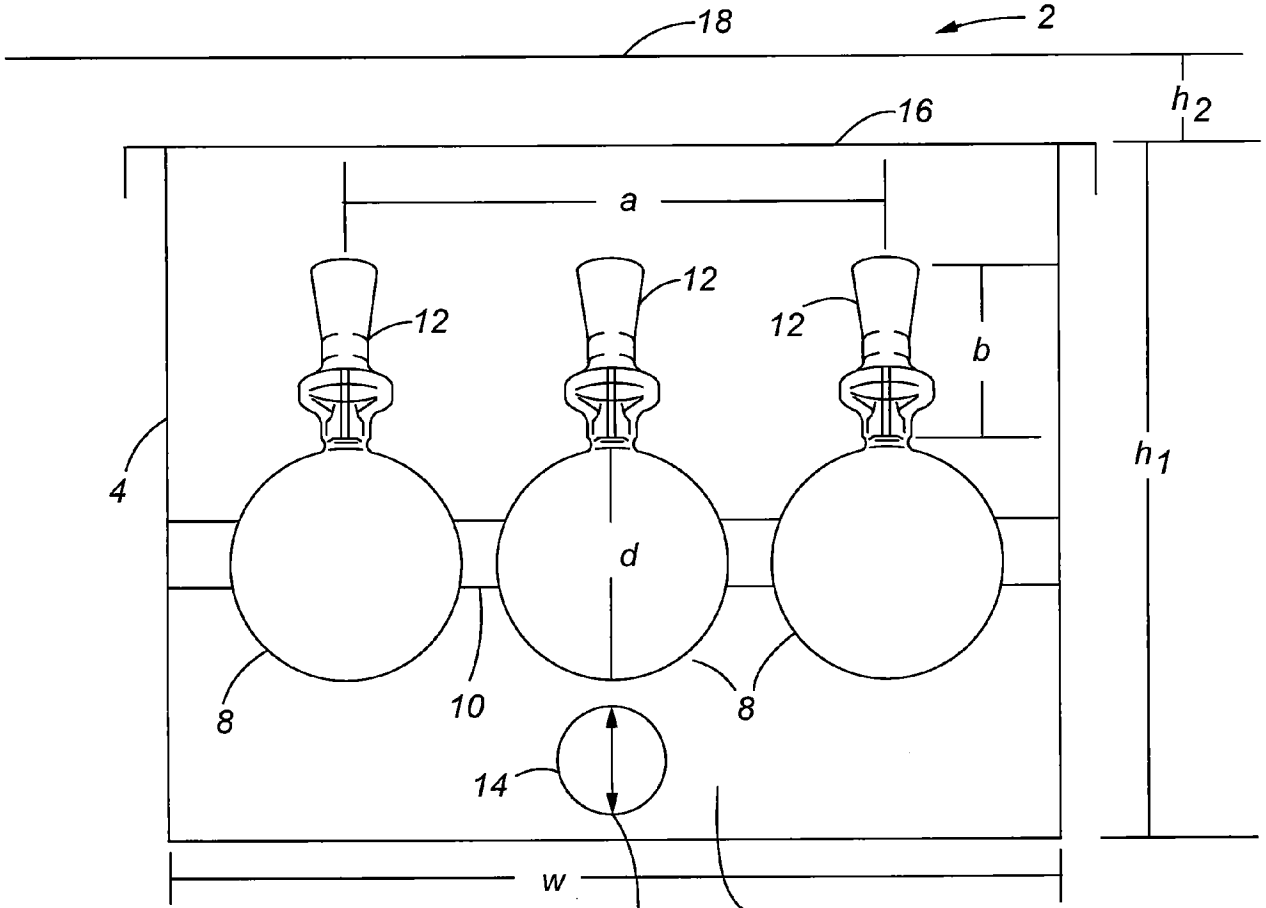
FIG. 4 is a left section view of the embodiment of the invention shown in FIG. 1 depicting the interconnection of the educator nozzles to the riser.
Figure 5:
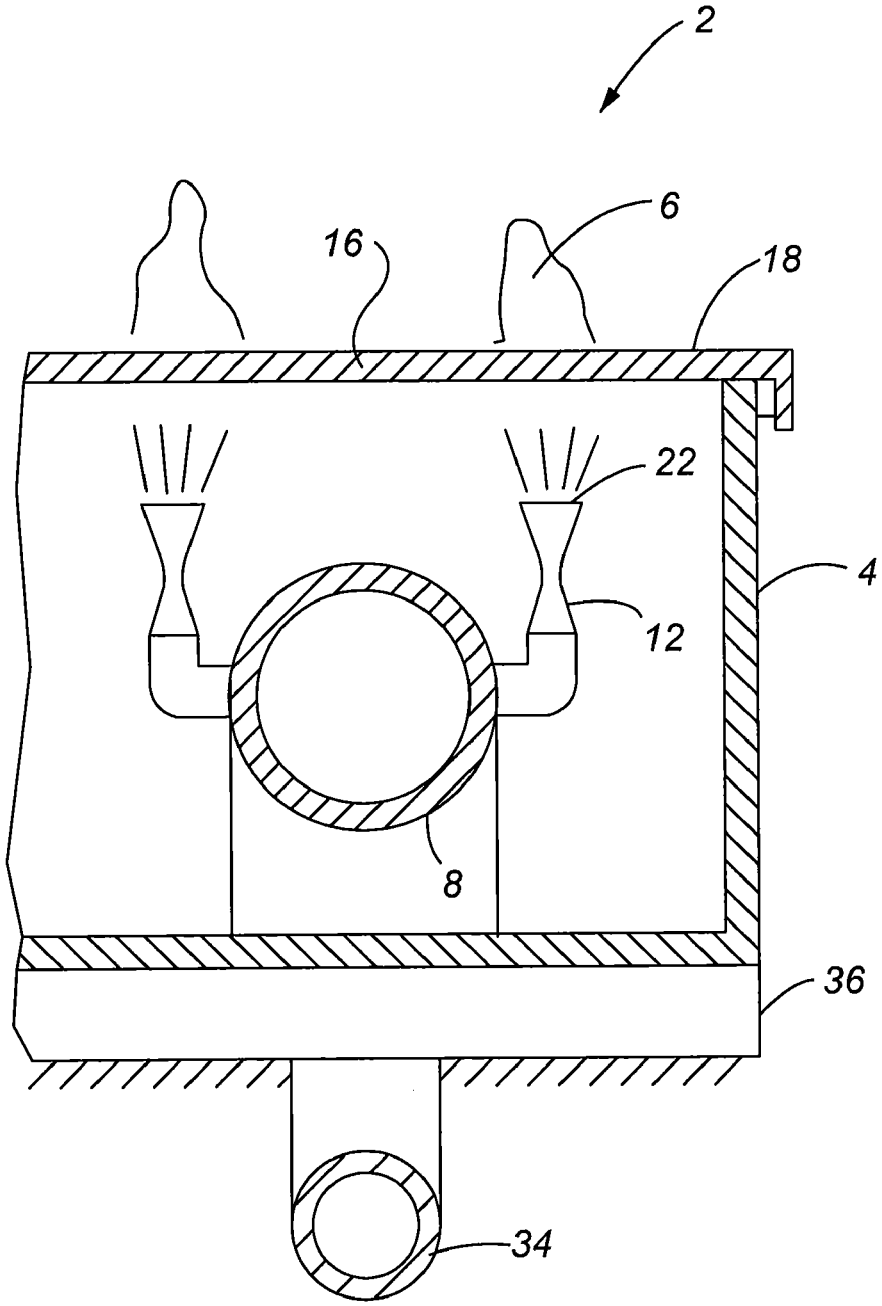
FIG. 5 is a partial left section view of the embodiment of the invention shown in FIG. 1 depicting the interconnection of educator nozzle pairs to the riser.

Referring specifically now to FIG. 3, a front section view of one embodiment of the present invention is shown herein that clearly depicts the etchant tank 4, the pump manifold 34, and the other associated components. More specifically, the riser 8 and interconnected nozzles 12 are depicted, as well as the nozzle discharge port 22, the moving mat 18, and an amount of etching solution 6 that is propelled after being discharged from the nozzle discharge port 22 through the surface of the etching solution.

Figure 6:
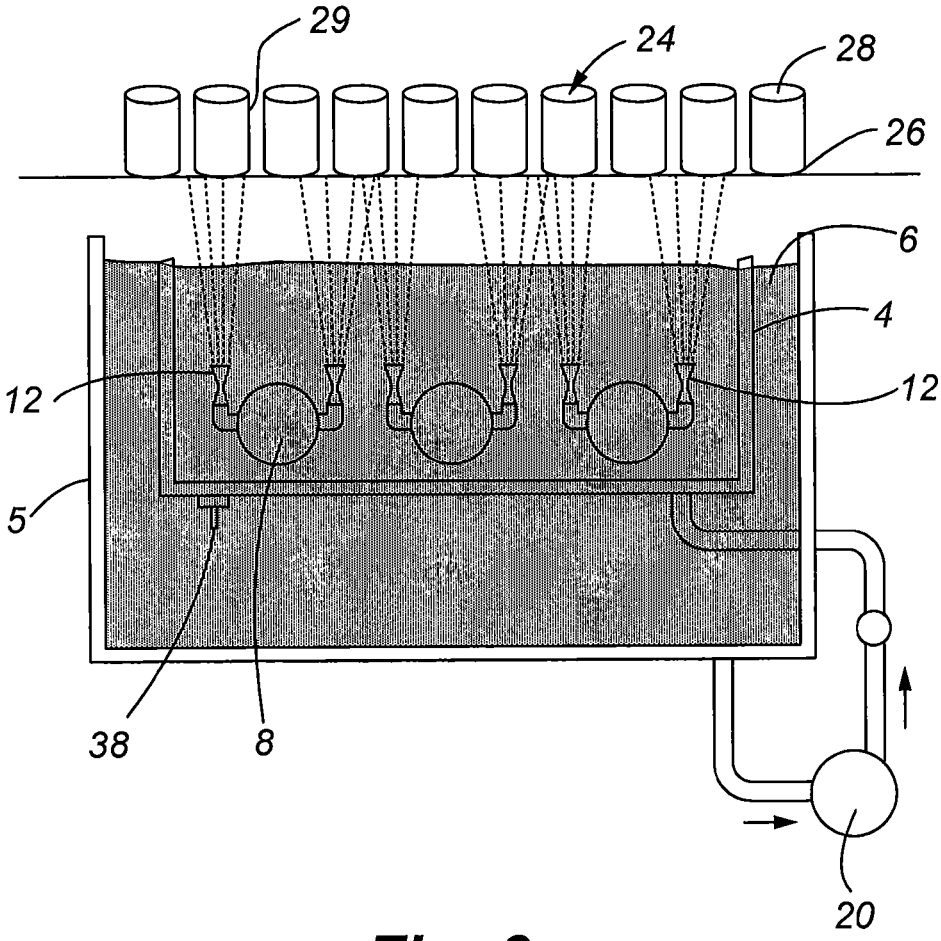
FIG. 6 is a partial left section view of the embodiment of the invention shown in FIG. 1 depicting the interconnection of educator nozzle pairs to the riser, wherein a holding tank is employed to contain excess solution, thus maintaining fluid level in the etchant tank.

Referring now to FIG. 6, an alternate embodiment of the present invention is shown herein. More specifically, a system that employs a holding tank 5 to capture overflow etching solution 6 from the etchant tank 4 is provided. This embodiment of the present invention maintains solution level in the etchant tank 4 by continuously pumping etching solution 6 thereto. The overflow is captured by a holding tank 5 that is then redirected to the etchant tank 4 for reuse. In addition, the concentration temperature, purity, etc. of the overflow etching fluid may be monitored and/or altered in the holding tank 5 to ensure the containers 24 are treated pursuant to specifications.

Figure 7:
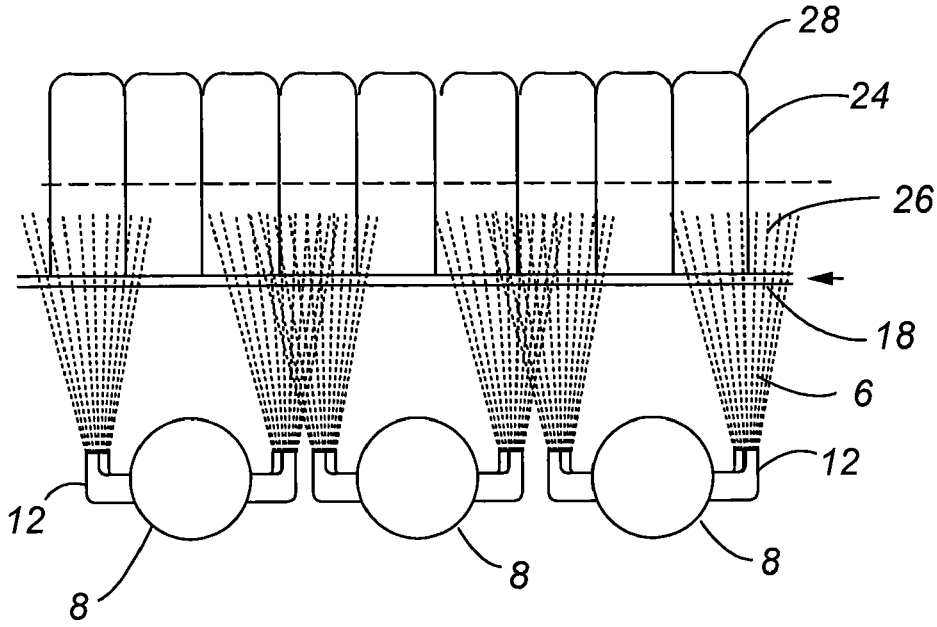
FIG. 7 is a left elevation view depicting the positioning of the containers on the washer mat and the orientation of flow from the educator nozzles.

Referring now to FIG. 7, a further depiction of the present invention is provided herein. More specifically, the risers 8 are shown positioned with a plurality of nozzles 12 extending on either side and oriented upwardly toward the moving mat 18. The plurality of containers 24 are supported by the moving mat 18, which in this example is constructed of rubber, stainless-steel mesh, plastics, or other materials commonly known in the art of about one-half inch thickness. The moving mat travels at a speed of between about 3 ft/min to 32 ft/min, and is driven in one embodiment by a 10-13 hp motor coupled to a 414 GPM pump, preferably a Durco® Mark III series device.

As further seen in FIG. 7, the positioning of the nozzles 12 with respect to the moving mat 18 and containers 24 is important to the effective operation of the apparatus. In this specific example, a distance of about 3½ inches is provided between the discharge port 22 of the nozzle 12 and the moving mat 18, while the etching solution 6 is propelled upwardly in the direction of the containers 24. The etchant tank solution 6 extends upwardly and approximately 2 inches over the container mat 18, while allowing the container dome portion 28 to remain a sufficient distance from the nozzles 12 to prevent exposure to the etching tank solution 6. As appreciated by one skilled in the art, the height of the solution 6 discharge may be adjusted as necessary by varying the operating speed of the pump and/or the size of the nozzle 12, for example. Alternatively, it is possible to position the nozzles above the liquid/air interface without submerging the nozzles.

Figure 8:
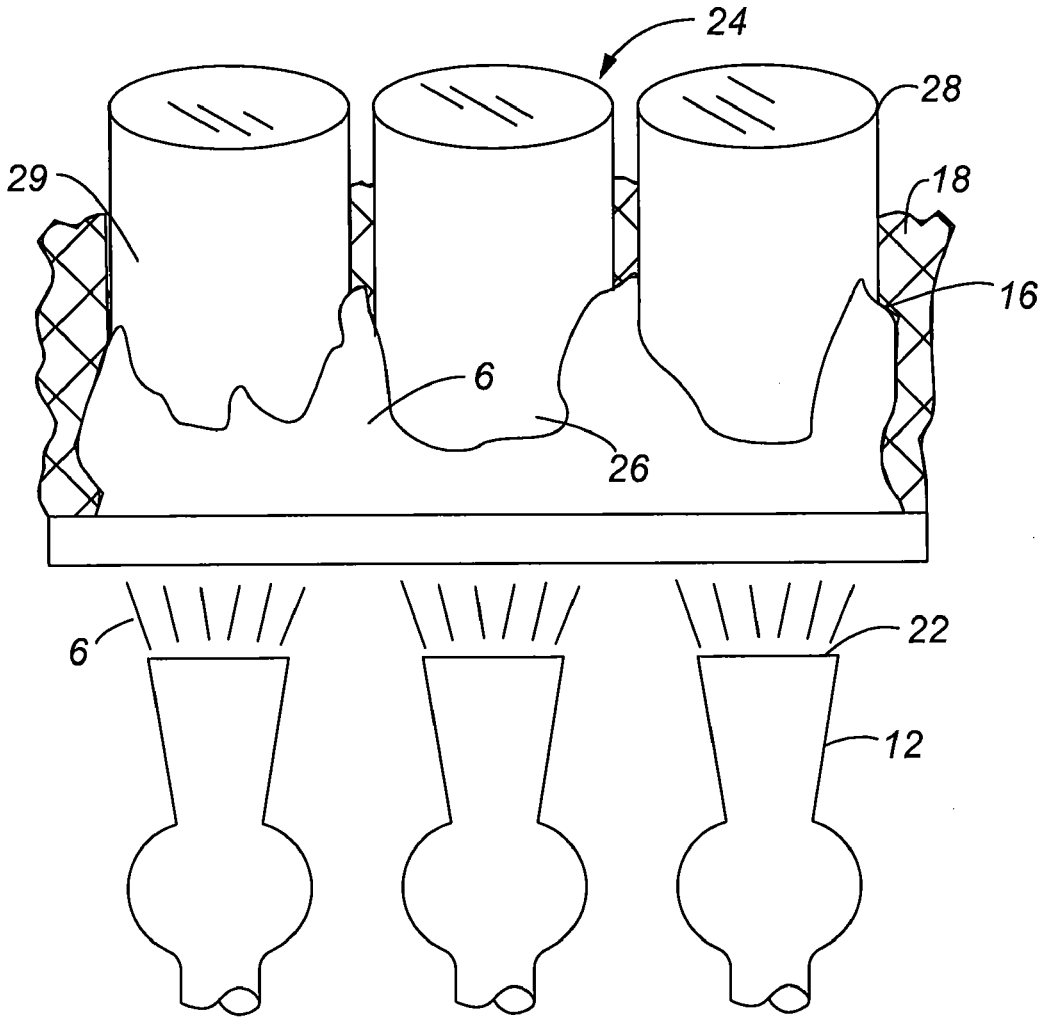
FIG. 8 is a left perspective view of a plurality of containers positioned on the washer mat and the discharge of solutions from the educator nozzles.

Referring now to FIG. 8, the positioning of the containers 24 with respect to the moving mat 18 and the nozzle discharge ports 22 is shown herein. More specifically, the height of the etchant tank solution 6 is depicted extending upwardly over a neck portion of a container neck 26 while not contacting with the container dome portion 28. One of skill in the art will appreciate that the neck portion 26 of a container 24 is positioned proximate to an upper end of a sidewall 29, the other end of the sidewall 29 being bounded by the dome portion 28, for example. This process effectively removes the coating from at least the container neck 26, while retaining the coating on the container dome portion 28 and on a portion of the sidewall 29. A plurality of nozzles 12 are provided that include a nozzle discharge port 22 that is positioned below the moving mat 18 and the containers 24 that are supported by an upper surface of the moving mat 18. The distance and positioning between the nozzle discharge port 22, the moving mat 18, and the associated containers 24 is dictated by any given application, and may vary depending on the size of the container 24, the speed of travel of the moving mat 18, the size of the pump 20 being utilized, and the type of nozzle discharge port 22, which are all factors that dictate the height of spray of the etching solution 6.

Figure 9:
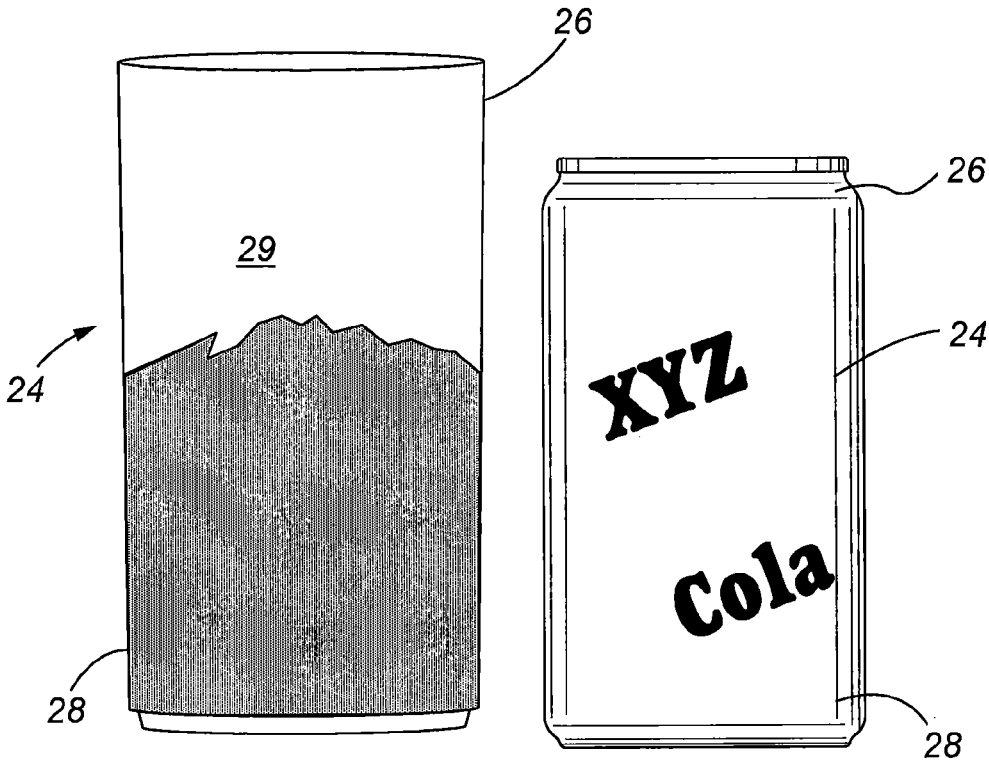
FIG. 9 is a front elevation view depicting the removal of the conversion coating from a neck portion of the container and a finished beverage container.

Referring now to FIG. 9, a front elevation view of an unfinished container is provided herein, as well as a finished container. More specifically, the unfinished container on the left side of FIG. 9 depicts a container with a container dome portion 28 and a container neck 26 with a sidewall 29 positioned therebetween. The conversion coating has been removed from the container neck portion 26 and a portion of the sidewall. An example of a finished container is shown on the right side of FIG. 9, wherein the neck has been sized to be interconnected to an end closure and filled for distribution by a customer.

Figure 10:
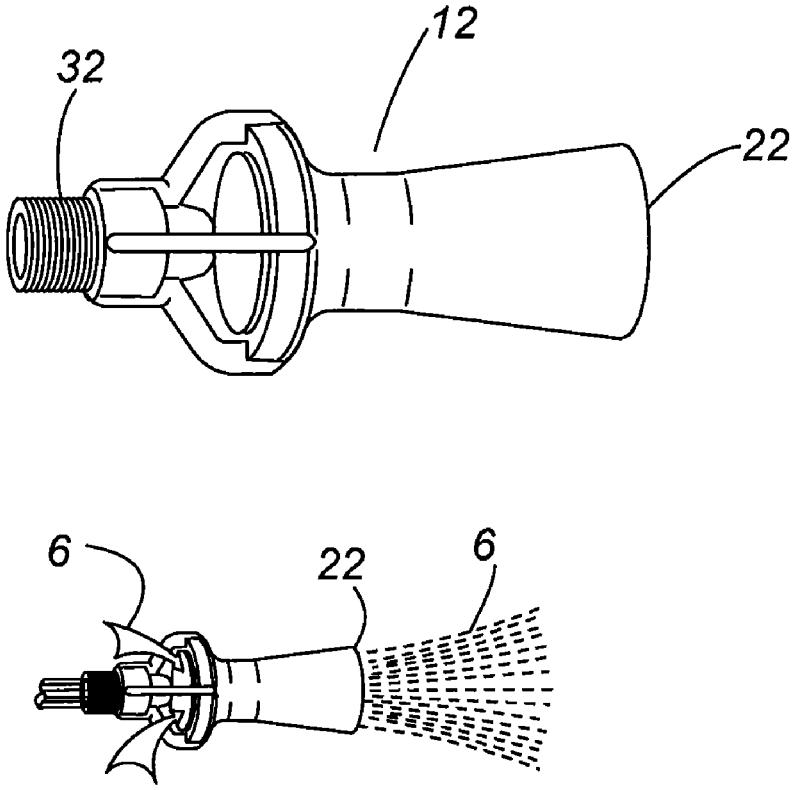
FIG. 10 are views of the educator nozzles used in one embodiment of the present invention.

Referring now to FIG. 10, front elevation views of one type of nozzle 12 used in the present invention is provided herein, and which identifies a nozzle thread 32 on one end and the nozzle discharge port 22 on the opposing end. The nozzle 12 may utilize parasitic flow to increase mass flow therethrough. Preferably, the nozzle 12 is provided by Spring Systems Company of Wheaton, Ill. As appreciated by those skilled in the art, there are any number of types of nozzles and nozzles 12 and nozzle discharge ports 22 that may be employed without departing from the scope of the present invention, and the example provided herein is but one example of various types of possible nozzles 12.

With reference to FIGS. 1-10, one embodiment of the present invention has a substantially rectangular etchant tank 4 that contains three risers 8 spaced about 5 to 7 inches (12.7 to 17.78 cm) from the bottom thereof. The etchant tank 4 of this embodiment has a length (l) of about 100 to 110 inches (254 to 279.4 cm), a width (w) of about 28 to 32 inches (71.12 to 81.28 cm), and a height (h1) of about 7 to 11 inches (17.78 to 27.94 cm). In addition, the risers 8 of this embodiment of the invention are about 2 inch (5.08 cm) diameter (d) pipes spaced 8 to 10 inches (20.32 to 25.4 cm) apart, wherein one riser 8 is situated substantially in the center of the etchant tank 4. The risers 4 of this embodiment of the invention are capable of supporting at least 92 nozzles 12, preferably in 46 pairs. Alternatively, fewer nozzles 12 may be interconnected in single file along the tops of the risers 3, wherein the exit of each nozzle 12 is preferably spaced about 3 inches (7.62 cm) from the outer diameter thereof. The moving grid 18 of one embodiment of the invention is about 0.5 inches (1.27 cm) thick and is situated (h2) about 2 to 2.5 inches (5.08 to 6.35 cm) from the upper surface of the etchant tank 8, which yields an etchant solution stream 6 that contacts about 2 inches (6.45 cm) of the inverted container 24.

While an effort has been made to describe various alternatives to the preferred embodiment, other alternatives will readily come to mind to those skilled in the art. Therefore, it should be understood that the invention may be embodied in other specific forms without departing from the spirit or central characteristics thereof. Present examples and embodiments, therefore, are to be considered in all respects as illustrative and not restrictive, and the invention is not intended to be limited to the details given herein.

What is claimed is:

1. A method for selectively removing a coating from a plurality of containers, each container of the plurality thereof having a dome portion on a first end and a neck portion on a second end, comprising:

providing an etchant tank that contains a solution known to remove a coating from the plurality of containers;

providing a plurality of upwardly oriented nozzles in said etchant tank, each of said nozzles having a discharge port positioned below a liquid level of said solution;

maintaining said solution at a substantially consistent height, wherein said nozzles are submerged below the liquid level of said solution at a substantially consistent depth;

providing a pump which circulates said solution to said nozzles;

inverting each container and passing each container of the plurality of containers above said etchant tank and above the liquid level of said solution, and above said nozzles at a predetermined distance; and discharging said solution through said discharge ports toward the plurality of containers while said plurality of containers are positioned above said nozzles and above said liquid level of said solution, wherein only the neck portion of each container is contacted by said solution to selectively remove the coating from the neck portion of the second end of each container while retaining the coating on the dome portion of each of said containers.

2. The method of claim 1, wherein said container is a beverage or food can.

3. The method of claim 1, wherein said solution is a water based composition comprising at least one of a nitric acid and a hydrofluoric acid.

4. The method of claim 1, wherein the coating on said container is a conversion coating comprised at least partially of a zirconium-phosphate material.

5. The method of claim 1, wherein said nozzles have an aggregate discharge rate of at least about 250 gpm.

6. The method of claim 1, wherein said passing step comprises placing the neck portion of said container on a moving mat that travels at a predetermined speed, said mat having a plurality of apertures to allow said solution to pass therethrough.

7. The method of claim 1, wherein said discharge ports of said plurality of nozzles are positioned below said liquid level of said solution at a distance of at least about 1-2 inches.

8. The method of claim 1, wherein said plurality of containers travel above said plurality of upwardly oriented nozzles at a rate of at least about 3-32 ft/min.

9. The method of claim 1, wherein said discharging step comprises pumping said solution from said etchant tank through said discharge ports in a continuous cycle.

10. The method of claim 1, wherein the coating can be removed from the container at a rate of at least about 1000-4000 containers/minute.

11. The method of claim 1, wherein the solution is maintained at a temperature of between about an ambient temperature and 160° F.

12. The method of claim 1, further comprising retorting the plurality of containers.

13. The method of claim 1, further comprising exposing said plurality of containers to a heat beyond 200° F.

14. The method of claim 1, further comprising applying ink to the plurality of containers.

15. The method of claim 6, wherein said moving mat is a wire mesh.

* * * * *